US005352165A

United States Patent [19]

Koblick

[11] Patent Number: 5,352,165

[45] Date of Patent: Oct. 4, 1994

[54] PERSONAL EXERCISE DEVICE

[76] Inventor: Jeffrey M. Koblick, 351 Townes Rd., Wayzata, Minn. 55391

[21] Appl. No.: 57,127

[22] Filed: May 3, 1993

[51] Int. Cl.[5] ..... A63B 23/04

[52] U.S. Cl. ..... 482/51; 482/148; 434/253

[58] Field of Search ..... 482/123, 27, 52; 40/604; 403/13, 388, 384; 248/396; 160/327, 354, 368.1, 380, 399, 402; 472/90

[56] References Cited

U.S. PATENT DOCUMENTS

| | | | |
|---|---|---|---|
| 2,952,024 | 9/1960 | Bartolucci | 160/368.1 |
| 3,025,613 | 3/1962 | Mitchell | 434/430 |
| 3,750,739 | 8/1973 | McGuire | 160/354 |
| 4,044,813 | 8/1977 | Emmons | 160/369 |
| 4,291,738 | 9/1981 | Grewga | 160/172 U |
| 4,779,862 | 10/1988 | Keppler | 482/51 |
| 4,940,228 | 7/1990 | Carra | 482/51 |
| 5,031,953 | 7/1991 | Miller | 403/13 |
| 5,114,387 | 5/1992 | Keppler | 482/51 |
| 5,192,467 | 3/1993 | Stone et al. | 160/402 |

*Primary Examiner*—Richard J. Apley
*Assistant Examiner*—Jerome Donnelly
*Attorney, Agent, or Firm*—Allegretti & Witcoff, Ltd.

[57] ABSTRACT

A personal exercise device on which an exerciser may slide back and forth. The exercise device includes a sliding mat as well as first and second end pieces. Each end of the mat defines a series of apertures. Each of the end pieces include a plurality of bosses and posts, which engage the apertures of the mat. Such assemblies prevent the mat from ripping away from the end pieces while an exerciser uses the mat and pushes against the end assemblies with her feet.

6 Claims, 3 Drawing Sheets

Fig. 4
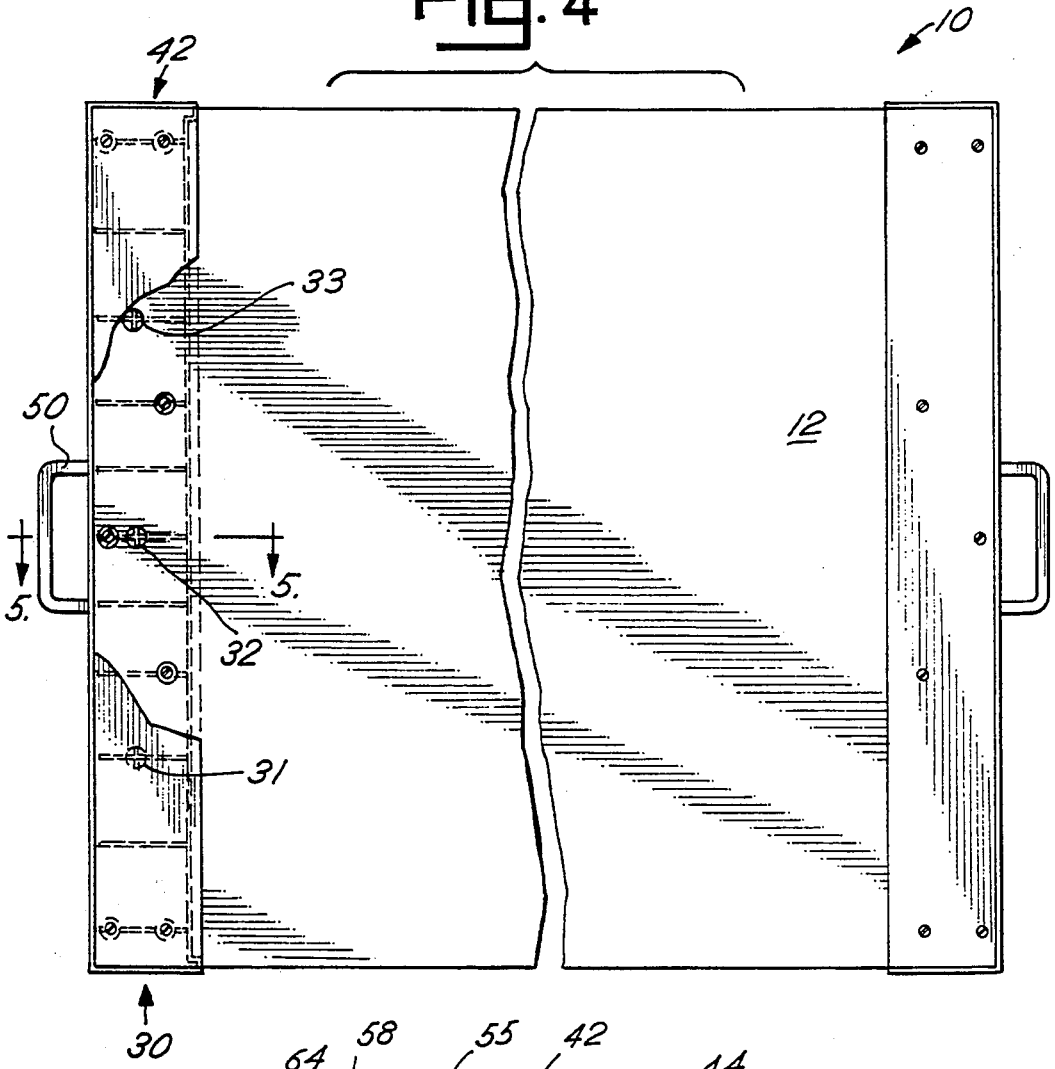
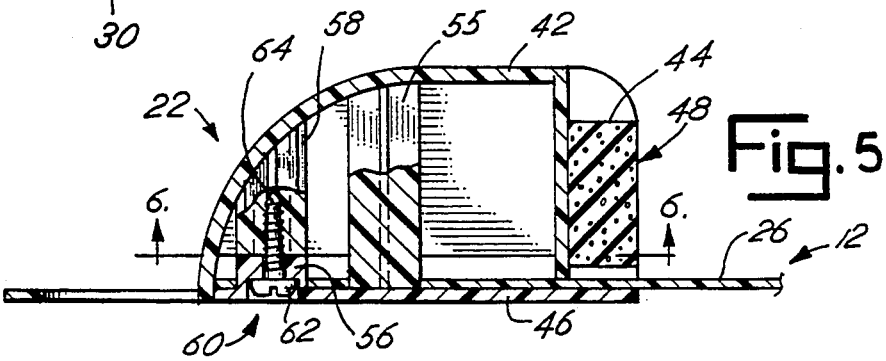
Fig. 5
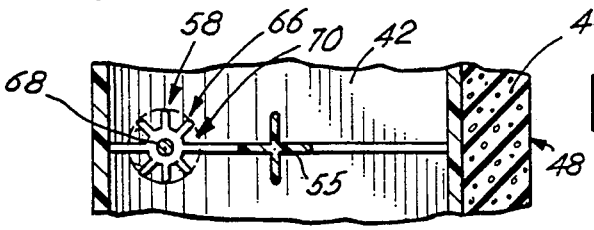
Fig. 6

PERSONAL EXERCISE DEVICE

BACKGROUND OF THE INVENTION

The present invention relates generally to exercise devices and, more particularly, to a device on which an exerciser may slide back and forth to obtain an aerobic benefit. Many presently available slide devices include a plastic sliding mat on which an exerciser may push with her (or his) legs to slide herself (or himself) back and forth along the mat and, thus, exercise the leg, as well as upper body, muscles.

Many of the devices may also include end pieces on opposites sides of the mat. The end pieces extend upwardly from the surface of the mat and block the exerciser's foot from moving past the end of the mat as she slides along the mat. Thus, the end pieces help stop an exerciser whose momentum would otherwise carry her over the end of the mat.

Further, each end piece is a substantially stationary support. The exerciser may place her foot against an end piece in order to push toward the other end of the mat.

Thus, substantial pressure may be applied to an end piece, both when it stops the movement of an exerciser and when an exerciser pushes against one end piece in order to slide toward the opposite end piece. Unfortunately, the presently available personal, sliding, exercise devices have not fully met the needs of many sliding exercise enthusiasts, since the end pieces may not be attached to the mat in an economical and reliable fashion.

Often, the end pieces may simply be screwed or bolted onto the mat, causing the mat to rip when pressure is applied to the end pieces. Further, screws may extend from the top of the end pieces. This provides an unsightly appearance as well as the risk that the screws might (as a result of becoming loose or as a result of imprecise manufacturing) extend upwardly over the top of the end piece. In such a case, the exerciser may injure herself by scraping her foot on the extended screws.

SUMMARY OF THE INVENTION

In a principal aspect, the present invention is a personal exercise device having a mat and one or more end pieces. The end of the mat defines one or more apertures. The end piece includes a housing and a base plate, which receive the mat, and an attachment mechanism. The attachment mechanism includes a boss, post, and pin. The boss extends through the aperture of the mat. The pin extends through the boss and into the post, holding the mat and end piece in a fixed relation.

Thus, an object of the present invention is an improved personal exercise device. Another object is a sliding exercise device with end pieces that are more resistant to tearing the sliding mat. A further object is a personal exercise device that is easier and less costly to manufacture. These and other objects, features, and advantages of the present invention are discussed or apparent in the following detailed description.

BRIEF DESCRIPTION OF THE DRAWINGS

A preferred embodiment of the present invention is described herein with reference to the drawing wherein:

FIG. 4 is a partial bottom view of the preferred embodiment shown in FIG. 1, with one of the base plates shown partially broken away;

FIG. 5 is a cross-sectional view of the end piece shown in FIG. 4, taken along line 5—5;

FIG. 6 is a partial cross-sectional view of the end piece shown in FIG. 5, taken along line 6—6;

DETAILED DESCRIPTION OF THE PREFERRED EMBODIMENT

Figure 1:
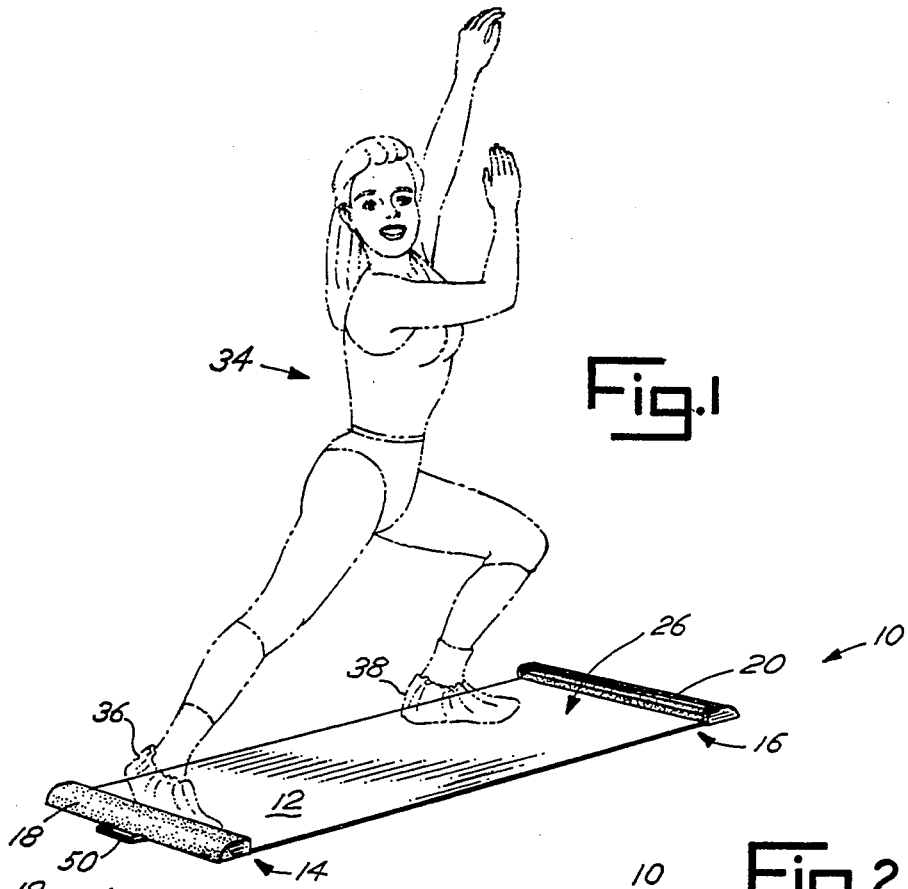
FIG. 1 is an isometric view of a preferred embodiment of the present invention showing, with phantom lines, an exerciser utilizing the invention.
Figure 2:
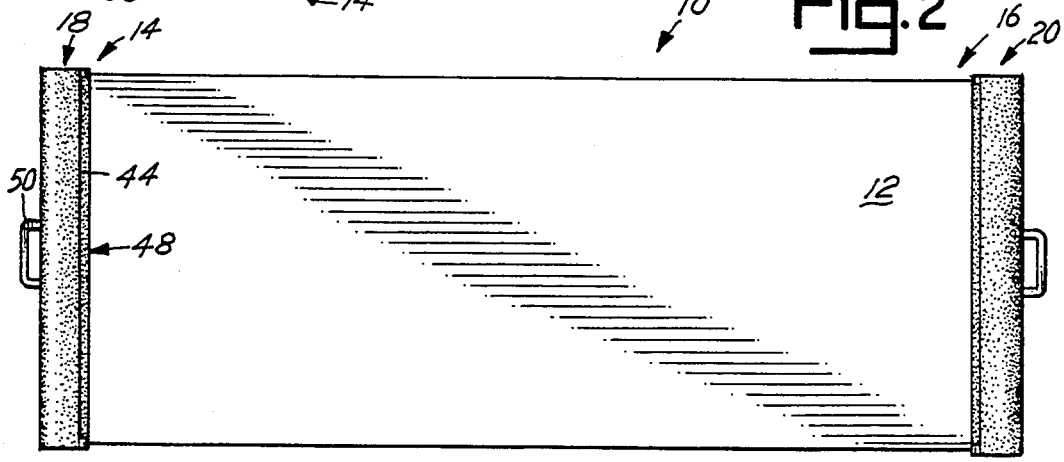
FIG. 2 is a top plan view of the preferred embodiment shown in FIG. 1.
Figure 3:
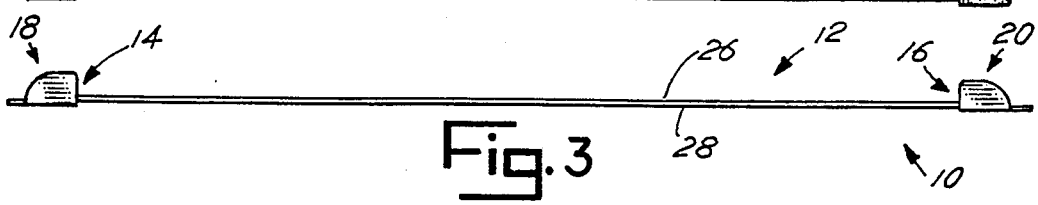
FIG. 3 is a front elevational view of the preferred embodiment shown in FIG. 1.

Referring to FIGS. 1–9, a preferred embodiment of the present invention is shown as a personal exercise device 10. The device 10 includes a sliding mat 12 having first and second ends 14, 16. The device 10 further includes first and second end pieces 18, 20, a first attachment mechanism 22 to hold the first end piece 18 to the first end 14 of the mat 12, and a second attachment mechanism 24 to hold the second end piece 20 to the second end 16 of the mat 12.

The mat 12 is comprised of plastic and has upper and lower surfaces 26, 28. In the preferred embodiment, the first end of the mat 12 also defines seven, substantially round gripping apertures, generally designated 30, and three alignment apertures 31, 32, 33, each of which is slightly larger than one-half inch in diameter. See FIG. 7. The upper surface 26 may have a coating on it (not shown) to reduce the coefficient of friction between the mat 12 and an exerciser 34 who slides back and forth along the upper surface 26 of the mat. The exerciser 34 may also wear, for example, nylon slippers 36, 38 to further reduce the friction between the exerciser 34 and the upper surface 26 of the mat 12.

The first and second ends 14, 16 of the mat 12 and the first and second end pieces 18, 20 have a substantially similar construction. Thus, for purposes of illustration, only the first end 14 of the mat, the first end piece 18, and the first attachment mechanism 22 are described in detail. The end piece 18 is made of injection-molded plastic and includes an upper, protruding housing 42, which extends above the upper surface 26 of the mat 12, a bumper 44, and a lower base plate 46.

The bumper 44 is made of an elastomeric material and is attached to the housing 42. As shown in FIGS. 2, 5, 8, and 9, the bumper 44 has a substantially rectangular cross-sectional shape. The bumper 44 presents a face 48 that is substantially orthogonal to the upper surface of the mat 12. The exerciser 34 may place one of her feet against the face 48 of the bumper 44 in order to "push off" toward the second end 16 of the mat 12. The elastomeric nature of the bumper 42 helps to cushion the exerciser's feet from impact.

Figures 7, 8, 9:
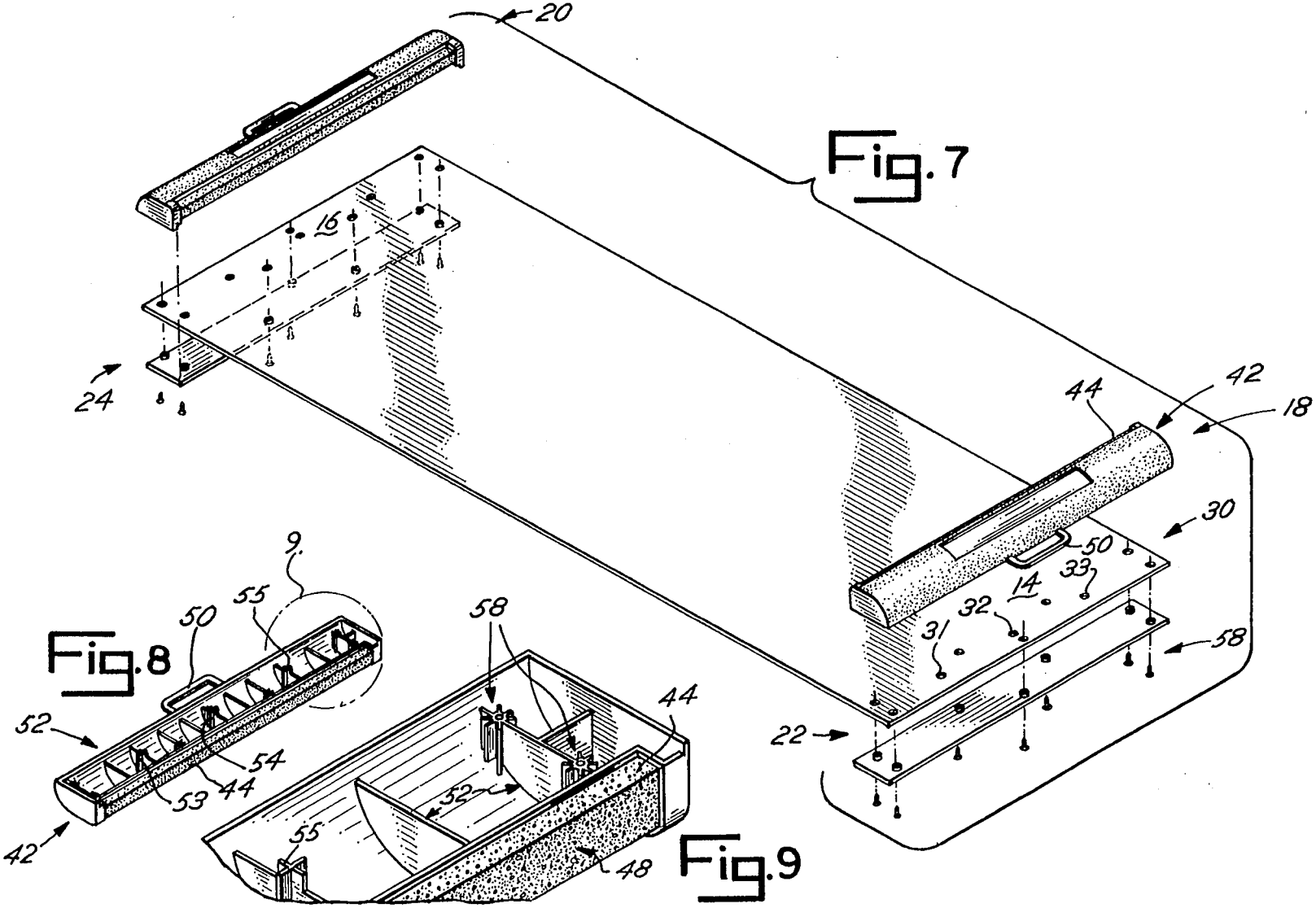
FIG. 7 is an exploded view of the preferred embodiment shown in FIG. 1.
FIG. 8 is an isometric view of a portion of an end piece shown in FIG. 1.
FIG. 9 is an expanded isometric view of the portion of the end piece indicated by circle 9 of FIG. 8.

The housing 42 of the end piece 18 also includes a handle 50 such that the device 10 may be more readily carried. The housing 42 and handle 50 may be molded as a single piece of plastic. As shown in FIGS. 8 and 9, the housing 42 further includes a plurality of reinforcing ribs 52 and three alignment ribs 53, 54, 55. The three alignment ribs 53–55 correspond to, and align with, the three alignment apertures 31–33 in the mat 12. The ribs 53–55 extend downwardly from the housing 42 toward the base plate 46 (when the device 10 is in its normal position, as shown in FIG. 1).

The first attachment mechanism 22 includes seven, substantially circular bosses, generally designated 56, extending from the base plate 46. The seven gripping apertures 30 of the mat 12 engagingly receive the seven bosses 56 of the base plate 46. The first attachment mechanism 22 further includes seven posts, generally designated 58, corresponding in location to the seven bosses 56 extending from the base plate 46. The posts 58 extend downwardly from the housing 42 toward the base plate 46. The first attachment mechanism 22 further includes seven screws or pins, generally designated 60. The term "pin" is defined to include any such elongate fastener, such as a screw. Each of the pins or screws 60 defines a head 62 (designed to matingly engage a screwdriver, not shown) and a pointed driving end 64.

Each of the seven bosses 56, posts 68, and screws 60 have substantially the same construction. The bosses 56, posts 58, and screws 60 cooperatively define the first attachment mechanism 22.

While the attachment mechanism 22 shown in the preferred embodiment utilizes seven bosses 56, posts 58, and screws 60, a different number may be used with the present invention. Generally, at least two, and preferably at least four bosses, posts, and screws may be used to properly secure the end piece 18 to the mat 12. Generally, the more screws spaced along the end piece 18, the lower the force that the exerciser 34 applies to any one screw while the device 10 is being used and, thus, the greater resistance that the end piece 18 has to tearing, or disengaging from, the mat 12.

Each of the posts 58 includes a plurality of fins 66 extending outwardly from an elongate central shaft 68. See FIG. 6. The fins 66 extend outwardly and substantially define, by their outward edges, a circle 70 substantially having diameter of one-half inch.

Each of the screws 60 may be placed through the base plate 46 and through the boss 56 and received by the central shaft 68 of the post 58. The central shaft 68 and fins 66 press against the boss 56. The screws 60 secure the base plate 46 to the to housing 42 and keep the bosses 56 and posts 58 pressed together, thus preventing the mat 12 from slipping off of the bosses 56.

The bosses 56 define a diameter substantially greater than the diameter of the screws 58. Thus, the bosses 56 present a greater surface area to the surrounding portion of the mat 12. Consequently, by employing the bosses 56, the end piece 18 is less likely to tear the mat 12 when force is applied to the end piece 18.

During assembly of the device 10, the housing 42 may be turned "upside down" from its normal position, such that it assumes the .position shown in FIG. 8. The first end 14 of the mat 12 may then be placed over the housing 42 such that the three alignment ribs 53–55 in the housing 42 align with the three alignment apertures 31–33 in the mat 12. In this way, the mat 12 and housing 42 are in a proper position relative to each other. Consequently, the bosses 56, posts 58, and gripping apertures 30 of the mat 12 are all properly aligned when the base plate 46 is put onto the housing 42. Further, when the screws 60 are then driven through the base plate 46 and bosses 56 and into the posts 58, the ribs 53–55 (and posts 58) provide added structural integrity to the end piece 18. Such structural solidness further assists in putting proper tension on the screws 60 when they are driven into the central shafts 68 of the posts 58.

A preferred embodiment of the present invention is described herein. It is to be understood, of course, that changes and modifications may be made in the embodiment without departing from the true scope and spirit of the present invention, as defined by the appended claims.

I claim:

1. A personal exercise device comprising, in combination:

a sliding mat having first and second ends, each of said ends defining a plurality of apertures; and a first end piece fixedly attached to said first end of said mat and a second end piece fixedly attached to said second end of said mat, and each of said end pieces further including:

a housing;

a base plate, said housing and base plate co-operatively receiving an end of said mat; and attachment means for holding said mat, housing and base plate together in a substantially fixed relation, said attachment means co-operatively defined by:

at least first and second bosses extending into said apertures of one of said ends of said mat, each of said bosses disposed between said base plate and said housing, and at least first and second pins, extending, through said first and second bosses, respectively, for holding said housing and base plate in a substantially fixed relation;

whereby an exerciser may slide on said mat between said first and second end pieces.

2. An exercise device as claimed in claim 1 wherein said attachment means further comprises a plurality of posts to receive said pins, each of said posts being substantially aligned with one of said bosses and one of said pins extending through said one of said bosses and into said post.

3. An exercise device as claimed in claim 2 wherein each said boss defines a predetermined diameter and said aperture substantially defines said same predetermined diameter.

4. An exercise device as claimed in claim 3 wherein each said pin comprises a screw having a head and a driving end, wherein said post is integrally formed with said housing, wherein said post includes a central shaft for receiving said driving end of said screw, and wherein said head of said screw abuts said base plate.

5. An exercise device as claimed in claim 4 wherein said mat defines at least two aperatures at both said first end and said second end and said attachment means comprises at least four bosses and four pins corresponding to said apertures.

6. An exercise device as claimed in claim 5 further comprising a handle interconnected to at least one of said end piece.

* * * * *